US010889475B2

(12) United States Patent
Haley et al.

(10) Patent No.: US 10,889,475 B2
(45) Date of Patent: Jan. 12, 2021

(54) COMPACT WINCH

(71) Applicant: Woods Hole Oceanographic Institution, Woods Hole, MA (US)

(72) Inventors: James A. Haley, Woods Hole, MA (US); Joshua A. Eaton, Woods Hole, MA (US)

(73) Assignee: Woods Hole Oceanographic Institution, Woods Hole, MA (US)

( * ) Notice: Subject to any disclaimer, the term of this patent is extended or adjusted under 35 U.S.C. 154(b) by 232 days.

(21) Appl. No.: 15/747,611

(22) PCT Filed: Aug. 4, 2016

(86) PCT No.: PCT/US2016/045466
§ 371 (c)(1),
(2) Date: Jan. 25, 2018

(87) PCT Pub. No.: WO2017/024093
PCT Pub. Date: Feb. 9, 2017

(65) Prior Publication Data

US 2018/0244507 A1 Aug. 30, 2018

Related U.S. Application Data

(60) Provisional application No. 62/201,133, filed on Aug. 5, 2015.

(51) Int. Cl.

| | |
|---|---|
| ***B65D 1/14*** | (2006.01) |
| ***B66D 1/14*** | (2006.01) |
| ***B66D 1/12*** | (2006.01) |
| ***B66D 1/38*** | (2006.01) |

(Continued)

(52) U.S. Cl.
CPC ..... *B66D 1/14* (2013.01); *B66D 1/12* (2013.01); *B66D 1/28* (2013.01); *B66D 1/30* (2013.01); *B66D 1/38* (2013.01)

(58) Field of Classification Search
CPC ... B66D 1/10; B66D 1/12; B66D 1/14; B66D 1/28; B66D 1/30; B66D 1/38
See application file for complete search history.

(56) References Cited

U.S. PATENT DOCUMENTS

| | | | |
|---|---|---|---|
| 3,627,087 | A | 12/1971 | Eskridge |
| 3,885,656 | A | 5/1975 | Michling et al. |
| 4,328,954 | A | 5/1982 | Logus |

(Continued)

FOREIGN PATENT DOCUMENTS

| | | |
|---|---|---|
| GB | 816724 | 7/1959 |
| GB | 2048201 | 12/1980 |

(Continued)

*Primary Examiner* — Sang K Kim
*Assistant Examiner* — Nathaniel L Adams
(74) *Attorney, Agent, or Firm* — Robert Devin Ricci; Richard L. Vail; Kean Miller LLP

(57) ABSTRACT

A lightweight winch suitable for industrial applications has the motor assembly self-centered with a housing within the winch drum where it may be easily accessed and removed from the winch drum. The winch drum is supported by a bearing means capable of bearing heavy loads in addition to contributing to a compact profile of the winch. The winch comprises an improved, non-load bearing levelwind mechanism for evenly winding cable about the winch drum.

13 Claims, 3 Drawing Sheets

(51) Int. Cl.
*B66D 1/30* (2006.01)
*B66D 1/28* (2006.01)

(56) References Cited

U.S. PATENT DOCUMENTS

| | | | | |
|---|---|---|---|---|
| 4,334,670 | A * | 6/1982 | Kawabe | B66D 1/38 242/397.3 |
| 4,507,044 | A | 3/1985 | Hutchins et al. | |
| 4,555,093 | A | 11/1985 | Plummer | |
| 4,565,352 | A | 1/1986 | Hasselmann et al. | |
| 4,760,971 | A | 8/1988 | Hodgetts | |
| 6,283,453 | B1 | 9/2001 | Berget | |
| 6,431,103 | B1 | 7/2002 | Meyerdierks | |
| 6,443,431 | B1 | 9/2002 | Stasny et al. | |
| 7,543,798 | B2 | 6/2009 | Cunningham | |
| 7,658,370 | B2 | 2/2010 | Rotzler | |
| 7,878,483 | B2 | 2/2011 | Van Der Laan | |
| 8,292,268 | B2 | 10/2012 | Kempf | |
| 9,248,999 | B2 | 2/2016 | Xydias | |
| 9,266,702 | B2 | 2/2016 | Fretz et al. | |
| 2011/0291061 | A1* | 12/2011 | Costas | B66D 1/28 254/332 |
| 2011/0303886 | A1 | 12/2011 | Cryer et al. | |
| 2015/0123057 | A1* | 5/2015 | Ogden | B66D 1/12 254/362 |
| 2016/0167747 | A1 | 6/2016 | Eaton et al. | |

FOREIGN PATENT DOCUMENTS

| | | |
|---|---|---|
| JP | S6075387 | 5/1985 |
| JP | H04173693 | 6/1992 |
| JP | H0484288 | 7/1992 |

* cited by examiner

COMPACT WINCH

CROSS REFERENCE TO RELATED APPLICATIONS

This application is the National Stage of International Application No. PCT/US2016/045466, filed Aug. 4, 2016, which claims the benefit of U.S. Patent Application Ser. No. 62/201,133, filed Aug. 5, 2015. This application incorporates by reference the U.S. patent application Ser. No. 14/963,570, filed on Dec. 9, 2015, the contents of which are hereby incorporated as if set forth herein in its entirety.

FIELD OF THE INVENTION

The present invention describes a compact winch with a motor and gear assembly disposed within the winch drum, reducing the size and clearance profile of the winch while providing a high strength hauling capacity.

BACKGROUND OF THE INVENTION

Winches are most often used in commercial and research operations for the hauling, retrieval, or otherwise adjustment of cable tension of heavy loads both on land and in marine environments. Generally, the basic elements of a winch system include a wide spool or winch drum mounted by a frame and rotated by a motor assembly or drive mechanism. The motor assembly connects to the winch drum to drive rotation to reel in or reel out cable wound around the winch drum.

Moreover, winches are often used in locations and settings with limited real estate to place and mount the winch. For example, industrial marine winches are generally attached to the deck of a vessel and are limited to specific regions of the vessel due to size clearances. Many conventional winches are not optimally configured to reside in limited spaces such as the deck of a vessel. Typical winches are configured with the motor assembly and other auxiliary components positioned adjacent to the winch drum, creating a large footprint on the deck. The overall housing for the assembly of the winch often comprises a large protective housing with an additional case for containing the motor assembly to prevent damage from external forces such as water, salt, dust, and other environmental and circumstantial conditions to the electronics. This extra space consumed by the protective winch housing makes it difficult to secure the winch in certain positions or at certain angles on the already limited vessel deck, thereby limiting the effectiveness of the winch.

Furthermore, the conventional housings are also not conducive to motor access as the motor assembly and other components have been fit tightly within the housing and sealed from the outside environment. Maintenance or repair to the motor assembly requires extensive dismantlement of the housing and/or winch assembly, consuming additional time and manpower. Providing easy access to the main motor assembly is a valuable feature especially when maintenance of the winch is necessary at the site of operation.

Prior efforts to integrate the entire winch motor assembly into the winch drum have encountered problems mainly due to the dispersal of heat. It is often difficult to provide a motor with the necessary torque capacity for the hauling purposes while adequately dispersing the heat generated by the enclosed motor assembly which is most often enclosed to protect the motor components from the external environment (e.g., water, salt, dust). While some internal motor designs utilize a completely closed drum filled with oil to surround the motor assembly and diffuse heat, this method precludes access to the motor assembly without complete drainage of the oil and the dismantlement of the winch. Other conventional methods have employed a series of electric fans to blow air through channels to cool the motor assembly, requiring additional components, maintenance, and energy.

Additionally, at the site of operation, more than one size winch is often required to manage the various vehicles or loads as each winch is usually only compatible with one cable type and/or cable length, limiting the weight hauling capacity and depth range of deployment. Few winches are currently available which allow the mounting of a plurality of cable types and lengths particularly both cable wire and synthetic rope.

Therefore, having a versatile, compact industrial winch with a motor assembly that is accessibly secured within the winch drum, and is also capable of mounting to multiple positions on a platform and handling a plurality of hauling needs is greatly advantageous in both the marine and land setting.

SUMMARY OF THE INVENTION

The invention relates to a compact, low profile winch for hauling and retrieval purposes in a variety of land, offshore, and aquatic applications, particularly in a marine environment including the deployment and retrieval of mooring lines, floats, buoys, underwater vehicles, scientific instruments, or other loads. In one or more embodiments, a lightweight, industrial winch, is discussed herein, generally comprising: a horizontal winch drum for storing cable, rotatable in a forward and reverse direction, further comprising a non-load bearing flange on each axial end; a disengagable motor assembly comprising a motor, a gearbox, and a housing; a drive means; a bearings means; a base; and a quick removal means; wherein the motor assembly is self-centered within the housing, the housing entirely disposed within the winch drum with a gap between the outer face of the housing and the inner face of the winch drum, and the housing is connected to the base; the motor assembly is engaged with the winch drum by means of the drive means at one axial end; the bearing means supports the winch drum, and the bearing means is attached to an axial end of the winch drum and is attached to the base; the motor assembly may be disengaged from the winch drum using the quick removal means without dismantling the entirety of the winch; and the winch is capable of hauling and supporting a heavy load on a cable.

BRIEF DESCRIPTION OF THE FIGURES

The drawings constitute a part of this specification and include exemplary embodiments of the Compact Winch apparatus, which may be embodied in various forms. It is to be understood that in some instances, various aspects of the invention may be shown exaggerated or enlarged to facilitate an understanding of the invention. Therefore, the drawings may not be to scale; instead, emphasis has been placed upon illustrating the principles of the invention. In addition, in the embodiments depicted herein, like reference numerals in the various drawings refer to identical or near identical structural elements. Embodiments of the present invention are represented in the accompanying drawings, wherein.

DETAILED DESCRIPTION OF THE ILLUSTRATED EMBODIMENTS

The subject matter of the present invention is described with specificity herein to meet statutory requirements. However, the description itself is not intended to necessarily limit the scope of claims. Rather, the claimed subject matter might be embodied in other ways to include different components or combinations of components similar to the ones described in this document, in conjunction with other present or future technologies.

Furthermore, the described features, structures, or characteristics may be combined in any suitable manner in one or more embodiments. In the following description, numerous specific details are provided, such as examples of platforms, winch components, motors, propulsion means, attachment means, drum bodies, cords, cables, drive means, and other various components. One skilled in the relevant art will recognize, however, that the Compact Winch apparatus may be practiced without one or more of the specific details, or with other methods, components, materials, and so forth for numerous uses. In other instances, well-known structures, materials, or operations are not shown or described in detail to avoid obscuring aspects of the invention.

Unless defined otherwise, the terminology used herein has the meaning commonly understood by a person skilled in the art to which this invention belongs. As used herein, the following terms have the meanings ascribed to them below, unless otherwise specified.

When a component is referred to as being "on," "engaged to," "connected to," "attached to," or "coupled to" another component, it may be directly on, engaged, connected or coupled to the other element or layer, or intervening components or layers may be present.

In contrast, when a component is referred to as being "directly on," "directly engaged to," "directly connected to," or "directly coupled to" another component, there may be no intervening components or layers present. Other words used to describe the relationship between elements should be interpreted in a like fashion (e.g., "between" versus "directly between," "adjacent" versus "directly adjacent," etc.).

As used herein, the term "and/or" includes any and all combinations of one or more of the associated listed items.

As used herein, the singular forms "a," "an," and "the" may be intended to include the plural forms as well, unless the context clearly indicates otherwise.

In this disclosure, "comprises," "comprising," "containing" and "having" and the like can have the meaning ascribed to them in U.S. Patent law and can mean "includes," "including," and the like; "consisting essentially of" or "consists essentially" likewise has the meaning ascribed in U.S. Patent law and the term is open-ended, allowing for the presence of more than that which is recited so long as basic or novel characteristics of that which is recited is not changed by the presence of more than that which is recited, but excludes prior art embodiments.

Figure 2:
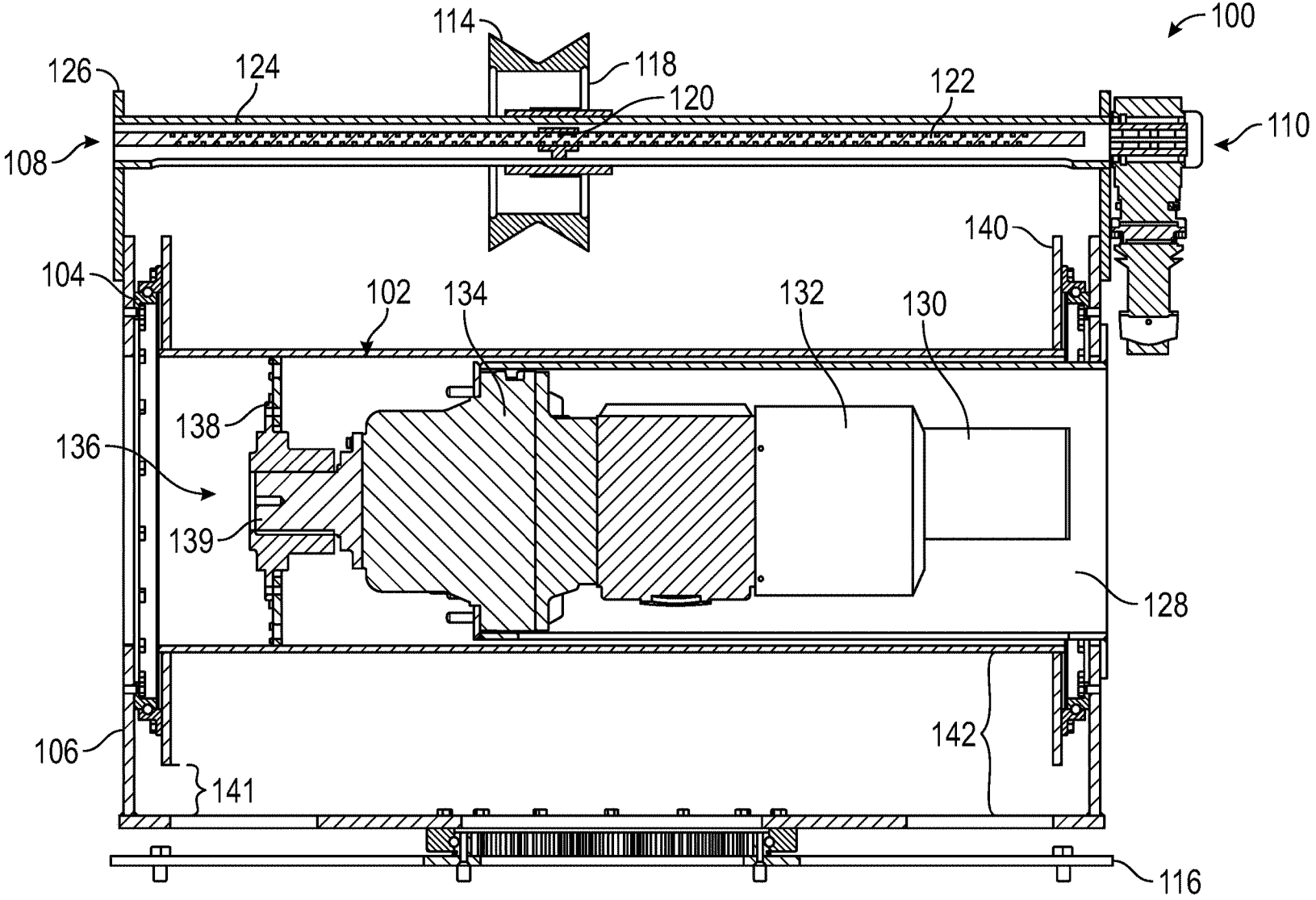
FIG. 2 is a longitudinal cross section schematic of one embodiment of the invention, illustrating the motor assembly and drive means disposed within the winch drum.

The present invention describes a lightweight, industrial winch design for use in a plurality of configurations and applications, particularly in the marine environment. While the winch 100 may be used in any suitable capacity, overall, the winch 100 is capable of hauling and supporting a heavy load on a cable such as a vehicle (e.g., an autonomous underwater vehicle (AUV), a remotely operated vehicle (ROV), a human occupied vehicle (HOV), a glider, or the like), a crate, a scientific instrument, deck equipment, moorings, or any other loads which require or may benefit from mechanical lifting, deploying, or supporting. As illustrated in FIG. 2, the winch 100 described herein provides a compact design which involves a motor assembly 130 disposed evenly within the internal space of the winch drum 102 by a housing 128 connected to and centered by the winch base 106 of the winch 100. Coupled to the winch drum 102 is a narrow profile bearing means 104 which reduces the side clearance of the overall system while providing a reliable, smooth rotation about the longitudinal axis of the drum and managing the heavy torque cabled load. The bearing means 104 is secured to a fixed winch base 106 designed to support the winch drum 102 and other internal elements using an amount of material for reduced weight and size considerations.

The winch 100 comprises a motor assembly 130 residing within the housing 128 which disengagably (e.g., removably) slides into an axial end of the winch drum 102. The removable installation of the motor assembly 130 is aided, in some embodiments, by the self-centering feature of the compact housing 128, as shown in FIG. 2. Another particular feature of this assembly method is the ease of accessibility to the motor assembly 130 for replacement or maintenance, an ability which is often made difficult by the bulky frame or inconvenient access points of conventional winches. The motor assembly 130 may be removed or at least easily accessed by one side end of the stationary housing 128, as illustrated in the side view of FIG. 2.

As the depicted embodiment of the present invention uses a winch drum 102 open (i.e., unsealed) on at least one axial end, passive air is allowed to flow through and around the motor assembly 130 to dissipate heat without hindering access to the motor assembly 130 or requiring added cooling components. In additional embodiments, the winch drum 102 is open on one end, while in alternate embodiments it is open on both ends. In yet alternate embodiments, the winch drum 102 has apertures to allow air to pass into it. Furthermore, centering the motor assembly 130 via a housing 128 within the winch drum 102 allows more surface area of the motor assembly 130 to be air-cooled.

As shown in FIG. 2, the integration of the motor assembly 130 reduces the overall height profile of the winch 100 unit as compared to a conventional winch which typically disposes its motor assembly in a case adjacent to, or at a raised position around, the winch drum 102. Moreover, the integration of the motor assembly 130 into the winch drum 102 frees additional area above and around the winch drum 102 to permit the rearrangement of the levelwind mechanism 108. The reduction in height clearance also allows the winch 100 to fit and operate within areas of lower clearance previously inaccessible to conventional winch models.

Figure 1:
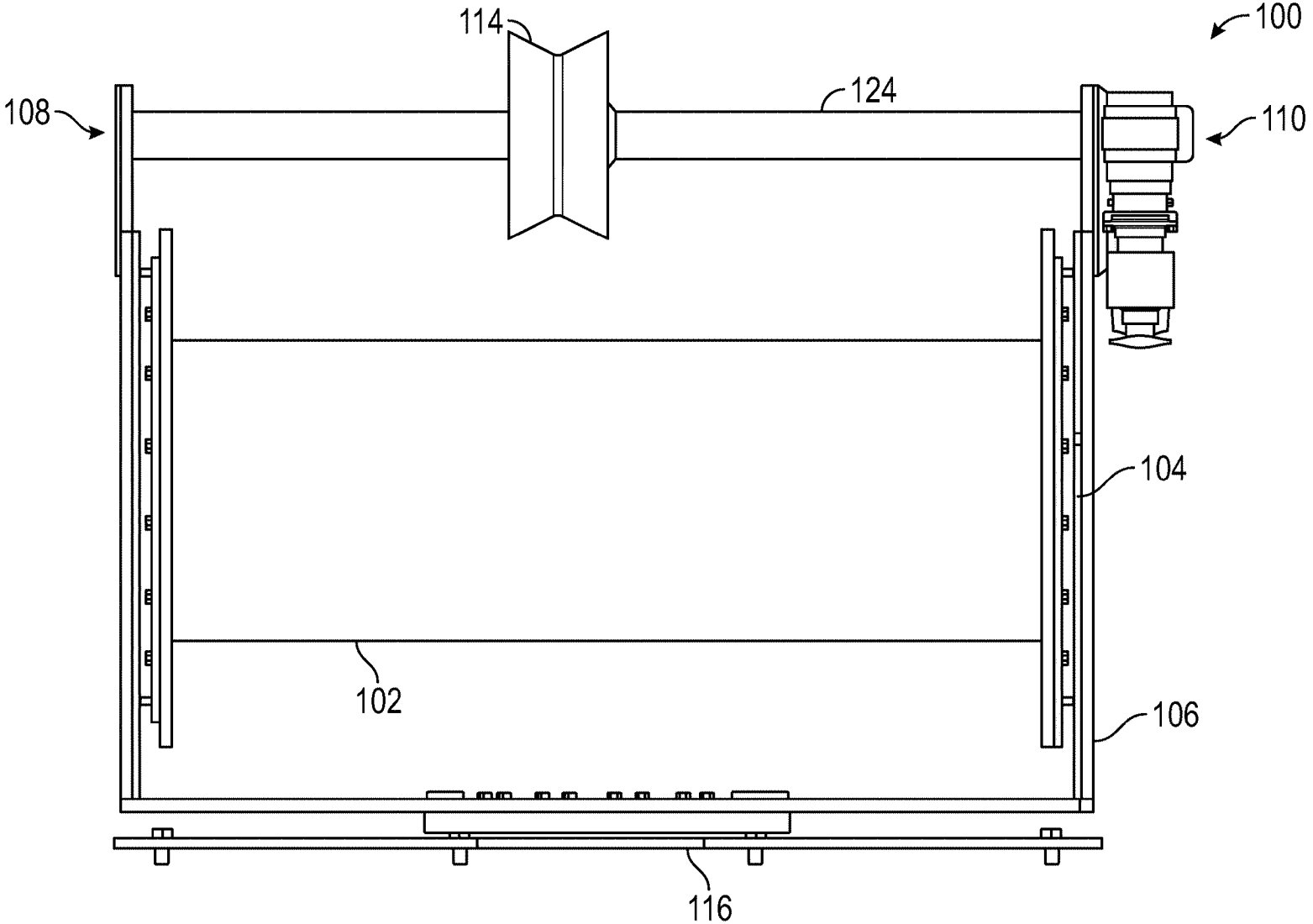
FIG. 1 is an overview schematic of one illustrated embodiment of the invention.

The overall footprint of the winch 100 is also substantially reduced by the new design, which further expands the possible attachment or operation positions of the winch. This decrease in footprint will have immediate impact in numerous fields of use such as the marine environment where space on a vessel is limited. Conventional winches routinely require large and bulky frames to secure the winch, the motor assembly, and the plurality of other components. The inventive winch 100, as illustrated in FIG. 1, is largely defined by the size of the winch drum 102 when the winch 100 is mounted directly onto a platform by the winch base 106. In various embodiments such as the one as shown in FIG. 2, the winch 100 may also be utilized with a low profile turntable 116 or other suitable mounting base as would be readily identified by one having ordinary skill in the art in light of this disclosure, which redefines the footprint of the winch 100 to the size of the turntable 116. Even in such embodiments, the winch 100 still consumes less deck space for operation than conventional winch constructions and may also be rotationally adjusted.

The side clearances of the inventive winch 100 is also condensed by replacing the conventional pillow blocks typically used in winch constructions for rotation with a slimmer bearing means 104, which in preferred embodiments are lightweight rolling element bearings (e.g., slewing bearings) with the strength capacity and force resistance equal or greater than heavy pillow block bearings or similar mountings.

The overall size reduction adds additional advantages which can be seen in various embodiments including lighter weight, easier transportation, simpler installation, and/or cost-effective fabrication. In at least one embodiment, the winch 100 requires no additional housing or framing; however, the winch 100 may be integrated into an existing housing or frame to mount to a desired position on a platform. In many cases, the winch 100 may be easily manually adjusted due to the reduction in weight and/or size.

The winch 100 also includes an improved lightweight levelwind mechanism 108 which further reduces the winch's 100 size clearance and weight. Conventional winch constructions spool the cable through the levelwind mechanism 108 disposed at a frontal position level with the winch drum 102. At this position, the levelwind must bear the weight and torque of the cabled load which most often requires a high strength double beam design. One or more embodiments of the inventive winch 100 reduces the levelwind mechanism 108 to a single lightweight beam 112 arranged above the winch drum 102 to remove any substantial torque forces from bearing upon the levelwind mechanism 108 during operation. Alternate embodiments may move the single lightweight beam 112 to other suitable non-load bearing positions. The levelwind motor assembly 110 is often mounted to the winch base 106 keeping the profile of the winch 100 as compact as possible.

As previously mentioned, the motor assembly 130 may be easily accessed and disengaged from the winch drum 102 via the quick removal means. As various vehicles or loads may be deployed and retrieved with a winch, it is common to have more than one size or type of winch available on site in order to manage all of the loading demands. One feature provided by various embodiments of the inventive model is the ability to utilize a plurality of cables or ropes of various type, length, and/or gauge (e.g., diameter), including synthetic rope, which may be exchanged with the inventive winch 100 to suit a specific load. Likewise, it is an object of at least one embodiment of this invention to provide a winch wherein the winch drum and/or motor assembly may be timely exchanged to one of suitable abilities for the task at hand and limit the individual winches required.

As shown in FIGS. 1 and 2, the motor assembly 130 is disposed within the winch drum 102, wherein the motor assembly 130 engages a drive means 136 to translate the power generated from the motor 132 into rotational force, driving the forward or reverse turning motion of the winch drum 102 during operation. At one end, the drive means 136 engages the motor assembly 130 while at the other end the drive means 136 is attached to the drum engagement means 138. The drum engagement means 138 connects to a portion of the winch drum 102 to provide drum rotation.

Rotation of the winch drum 102 is further facilitated by the bearing means 104 which is generally disposed on one or both adjacent axial ends of the winch drum 102. The winch drum 102 is attached to the rotatable inner surface of the bearing means 104, while the fixed outer surface of the bearing means 104 connects to the winch base 106 (which comprises the winch frame and drum mount). In some instances, the winch base 106 is directly mounted to the platform but is often attached to a turntable 116 which is attached to the platform.

The system comprises additional components such as the levelwind mechanism 108 which is attached to the winch base 106 and in contact with the cable being wound about the winch drum 102. The levelwind mechanism 108 is powered by the levelwind motor assembly 110 to drive rotation of the lead screw 122 and screw nut 120 which is attached to the carriage 118 engaged with the sheave 114. The cable wound about the winch drum 102 passes over the sheave 114 to connect to the vehicle, heavy load, or other rigging for deployment/retrieval.

Another advantageous aspect of the present embodiment is the redesigned portable controller to provide remote operation around the platform. The motor assembly 130 is connected to a power source and is regulated by the controller. The controller may plug into a suitable terminal wherein the terminal is appropriately connected to the motor assembly 130 to signal control of motor speed and rotation direction.

Winch Drum

The winch 100 comprises a horizontal winch drum 102 for storing cable and withstanding distortion under applied torque and tension forces. As illustrated in FIG. 2, the winch drum 102 holds the motor assembly 130, stores the cable wrapped around the winch drum 102 in successive layers, and is rotatable in a forward and/or reverse direction. In order to provide a compact and heavy load-bearing winch, the winch drum 102 maintains adequate load-bearing abilities to transfer and manage the load forces off of the flanges 140 which are often a weak link in winch design. Thus, the flanges 140 may be constructed to be non-load bearing flanges. The cable attaches to the winch drum 102 or other portion of the winch 100 and is wound around the longitudinal axis of rotation preferably in an even distribution along the length of the winch drum 102. The winch drum 102 may be any suitable drum, reel, spindle, or body to wind and reel out cable for the intended hauling purposes. In some embodiments, the winch drum 102 is interchangeable with another winch drum appropriate for the task.

Figure 3:
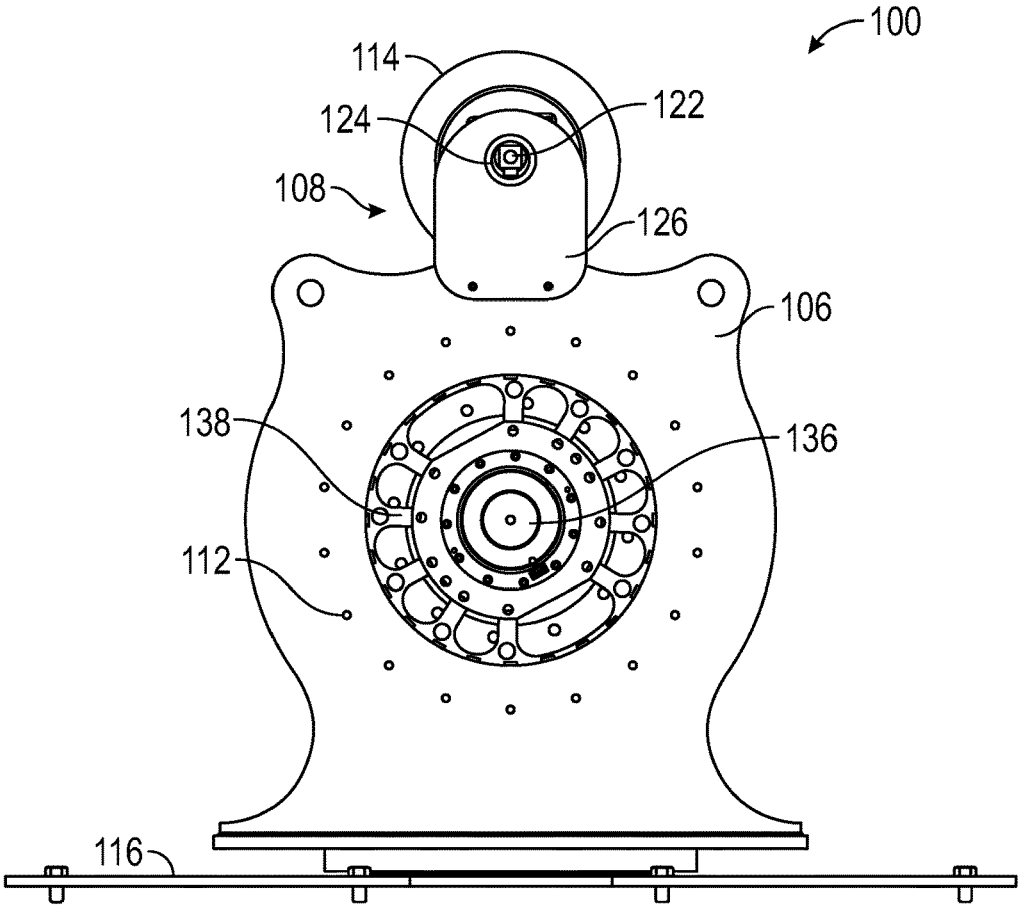
FIG. 3 is a side view schematic of one embodiment of the invention.

The winch drum 102 is generally a horizontal cylindrical shape open (i.e., unsealed, accessible, exposed, or at least partially open) on at least one axial end, preferably open on both of the axial ends (as illustrated in FIG. 3) to further eliminate excess material and to provide air cooling to the motor assembly 130 disposed within the winch drum 102. In specific cases where the winch 100 may be submerged, heavily splashed with fluid, or exposed to damaging environmental conditions, the winch drum 102 is partially sealed or completely sealed. Disposed on at least one and preferably each axial end of the winch drum 102 is a flange 140.

Flanges

In conventional winch constructions, the flange is an integral structural member of the winch which bears the torque forces applied during winch operation. In design of the flange, it is general practice to provide a flange at each end of the drum to resist the lateral and torsional forces and crushing cable load during winch operation. The flange of those constructions must be of a diameter and thickness to prevent shearing or deforming under force and maintain uniformity and parallel drum ends which in some cases requires heavy reinforcing webs or trusses to further strengthen the flange. Such reinforcements add more weight and cost to the winch. The present inventive winch 100 shifts the torsional forces off of the flanges 140 and onto the winch drum 102 to lessen the need for reinforced additions and reduce material and weight while providing comparable hauling capacity for industrial purposes.

The flanges 140 are secured (e.g., welded, bolted, adhered, mechanically attached) at each axial end of the winch drum 102 to prevent overspill of cable off of the drum 102. Overspill of the cable occurs when the cable jumps out of its designated position on the winch drum 102 or is not wound directly adjacent to the already laid cable. By replacing the traditional bulky pillow block bearings with the highly reliable and high strength bearing means 104, the winch 100, particularly the winch drum 102, is capable of bearing more force (e.g., heavy load) to reduce the strain on the flanges 140. Thus, the flanges 140 are designed to be non-load bearing in some embodiments which allows for manufacture from a lighter and/or thinner material to further facilitate a lightweight, compact design. For example, conventional winches may require the flanges to be constructed from 3¼" thick steel whereas the winch 100 may be made of a material less than 3¼" thickness, be it steel or a lower strength, more cost-effective material. In some embodiments, the flanges 140 are less than ¼ inch, less than ½ inch, less than 1 inch, less than 2 inches, less than 3 inches, or equal or greater than 3¼ inches thick. However, the flanges 140 are preferably constructed from an appropriate material and set of specifications to maintain proper form and resist shearing. The diameter of the flange 140 is most often determined by the diameter of the winch drum 102 and the amount of flange 140 exposed radially past the top layer of the wrapped cable (i.e., freeboard).

In some embodiments, one or more additional flanges 140 is provided at a vertical middle position on the winch drum 102 (e.g., split drum) to allow more than one cable to wrap around the winch drum 102 without entanglement (e.g., interaction).

The winch drum 102 may be any suitable size for the desired application. In general, the winch drum 102 is kept to a compact size to house the motor assembly 130 and to withstand torque and other forces without deforming. However, other considerations for diameter size include the speed of rotation and the cable storage capacity. In some embodiments, the winch drum 102 is the same size as a conventional winch drum. In other embodiments, the drum 102 is larger in diameter than conventional drums. When a larger winch drum 102 is selected, greater torque is generated, and the winch drum 102 rotates at a slower speed in comparison to a smaller diameter winch drum 102. Slower rotation may be beneficial in some cases as the slower speed and reduced number of turns reduces wear and tear on both the cable and the mechanical components of the winch 100 to extend the lifespan. In some embodiments, a larger winch drum 102 is used for the subject invention for the above reasons which may be accommodated by the reduction in winch size by the narrow bearing means 104, the levelwind mechanism 108 arrangement, the internally disposed motor assembly 130, and/or a combination of the aforementioned components.

The winch drum 102 is generally constructed from a high strength material and designed to a specific thickness to adequately resist distortion by torque and tension forces applied under load. In conventional winch designs, the levelwind is often a structural member of multiple high strength beams to bear a significant portion of the applied forces; however, as many embodiments of the inventive winch 100 utilize the disclosed levelwind mechanism 108, the winch drum 102 bears most and in some cases, all of the applied forces. In other embodiments, the winch drum 102 may bear only a portion of the applied forces. Suitable materials are described in more detail below. As discussed herein, the thickness of the winch drum 102 is measured as the distance of material between the inner face of the winch drum 102 to the outer face of the winch drum 102 which can vary depending on the needed weight-bearing capacity. In some embodiments, the winch drum 102 is less than ¼ inch, about ¼ to ½ inch, about ½ to 2 inches, about 2 inches to 5 inches, or greater than 5 inches thick.

In one or more embodiments, the winch drum 102 is substantially smooth or at least grooveless to accommodate different types and sizes of cable and may rely on the levelwind mechanism 108 or other suitable method to evenly distribute the cable on the winch drum 102 during operation. In other embodiments, the winch drum 102 is grooved to assist with symmetrical cable loading/winding. The grooves can be cast on the winch drum 102 or machined as separate pieces that are mechanically affixed to the winch drum 102. In various applications of such an embodiment, it may be desired that the grooves be slightly larger than the cable in use to avoid pinching and allow cable to adjust itself to the curvature of the winch drum 102, although this would not be necessary for every embodiment to function.

In yet some alternate embodiments, the winch 100 utilizes a split winch drum 102 for providing one or more cables on the same winch drum 102.

Motor Assembly

The motor assembly 130, which is disengagable in some embodiments, provides the power and control of rotation to turn the winch drum 102 for extending and retrieving the cable and the attached load. As further depicted, the motor assembly 130 is disposed at least partially.) if not entirely within the housing 128. For example, in alternate embodiments, this may mean that only the gearbox 134 is disposed internally, half of the motor assembly 130 disposed internally, half is disposed internally, three quarters of the motor assembly 130 is disposed internally, or the like. In many embodiments such as the one shown in FIG. 2, the motor assembly 130 may be mounted within the housing 128 with the motor axis parallel to the winch drum 102 axis of rotation. In many embodiments, the motor assembly 130 is engaged with the winch drum 102 by means of the drive means 136 on at least one axial end.

The disengagable motor assembly 130 comprises the motor 132, the gearbox 134, the housing 128, a motor brake, and a controller. A feature of the present invention is the flexibility to integrate numerous suitable motor assemblies 130 within the housing 128 which can then be easily removed without the complete dismantlement of the winch 100 through the quick removal means. While most constructions integrate a single motor assembly 130 into the winch drum 102, additional embodiments are envisioned to include multiple motors (e.g., 2, 3, 4, 5, 6, 8, 10 motors or more) within the internal space of the winch drum 102, of the housing 128, or other component. The multiple motors may be arranged in any suitable fashion, but in most cases are evenly distributed (such as radially distributed in some embodiments) to balance weight and torque forces. For example, in embodiments comprising multiple motors, each of the multiple motors may be provided within an individual housing 128 within the winch drum 102 or may be arranged together within a single housing 128 in the winch drum 102.

The motor 132 is generally an electric motor. However, the winch 100 and the motor assembly 130 are readily adaptable to allow different types and sizes of motors and motor components like a gearbox, motor brake, and/or drive means to be utilized. In order to be a "suitable" motor, the motor 132 must be able to provide the necessary torque for the intended use and accommodate the size and weight parameters of the cabled load. In addition to common electric motors, other motors that may be suitable include without limitation synchronous motors, induction motors, AC motors, DC motors, slip ring motors, hydraulic motors, permanent magnet motors, or any motor suitable for integration into a compact region. In a certain embodiment, the motor 132 is a variable speed DC electric motor.

Gearbox

The gearbox 134 transmits the force generated by the motor 132 to a plurality of gears arranged in an assembly which revolve and rotate the drive means 136. The gearbox 134 is generally matched to the motor 132 to mechanically fit and provide adequate rotation of the drive means 136. In many cases, the gearbox 134 is a helical gear assembly engaged with the motor 132 and the drive means 136, although other gears such as planetary gears, worm gears, or the like may be used. In many embodiments, the gearbox 134 is a compact arrangement of gears disposed in a closed housing 128 to protect the gears from environmental factors such as water, salt, or dust. In some constructions, the gearbox 134 is filled with oil or other fluid like lubrication, mineral oil, synthetic oil. In other cases, the gearbox 134 is not filled with fluid or may comprise openings.

Motor Brake

The motor assembly 130 includes a motor braking system to slow down, stop, and prevent rotation of the winch drum 102 such as when a load is held in midair or disposed off of the platform or the winch 100 is not in operation. Suitable motor brakes depend on the type of motor 132 in use with the winch 100. In general, the motor brake acts in an On/Off manner, allowing or preventing rotation of the winch drum 102. In some embodiments, the motor brake is used to regulate or limit the speed of the winch 100. Suitable braking systems for the motor assembly 130 include an electrical dynamic brake, a hydraulic brake (which may comprise a wet disc, dry disc, and/or band), electric brake, a fail-safe brake for automatic stop for power interruption), a manual brake, a locking pawl (ratchet) brake, a magnetic brake, or other suitable braking means.

In some embodiments, the motor brake acts upon the motor 132 or other appropriate motor component. In some embodiments, the inner or outer surface of flange 140 provides a surface for a motor brake (i.e., the brake disc) to press against to prevent rotation of the winch drum 102. In other embodiments, the motor brake is fitted to act upon the winch drum 102.

Power Source

The motor assembly 130 is connected to a power source by a means known to one skilled in the art. In some embodiments, a suitable cable or terminal connects the motor assembly 130 to the power source through a means such as a junction box. The power source may be any suitable means for providing the energy to drive rotation for the winch 100 such as a battery, hydraulic power pack, power generator, but in most cases is a plug-in connection to a nearby outlet.

Housing

As illustrated in FIG. 2, the housing 128 accommodates and secures the motor assembly 130 in a steady and immobile manner relative to the rotatable winch drum 102. The motor 132 and the gearbox 134 are supported within the housing 128 wherein the gearbox 134 projects through the housing 128 to engage the drive means 136. In some embodiments, the motor assembly 130 is supported in the housing 128 by attaching to a portion of the housing 128 which may be to the end of the housing 128 disposed in the winch drum 102, to the middle inside of the housing 128, to the end of the housing 128 connected to the winch base 106, and/or any other suitable position in or on the housing 128. In some embodiments, the housing 128, comprising the motor assembly 130, is supported (e.g., connected, mounted) by the connection to the drum engagement means 138 and to the winch base 106.

In the depicted embodiment, the housing 128 is capable of sliding into the winch drum 102 wherein one end of the housing 128, comprising the motor assembly 130, is disposed within the winch drum 102 with a gap or space between the outer face of the housing 128 and the inner face of the winch drum 102, and the second end of the housing 128 is connected to the winch base 106. The motor assembly 130 is most often self-centered within the housing 128. The self-centering feature of the winch 100 is provided by securely attaching the housing 128 (disposed within the winch drum 102 and comprising the motor assembly 130) to the winch base 106. When the housing 128 is attached in stationary position to the winch base 106, the winch drum 102 and the bearing means 104 are free to move independently relative to the housing 128. In some embodiments, the gap between the outer face of the housing 128 and the inner face of the winch drum 102 may be less than 12 inches, less than 10 inches, less than 8 inches, less than 6 inches, less than 4 inches, less than 2 inches, less than 1 inch, less than 0.5 inch, or less than ¼ inch, while in other embodiments it may be greater.

In at least one embodiment, the housing 128 enters one axial end of the winch drum 102 by sliding through an open portion on the side of the winch base 106 which is aligned with the center of the bearing means 104, as shown in FIG. 2. The housing 128 attaches to the outer surface of the base 106 (or any other suitable portion of the winch) using attachment means 112 (which may comprise nuts bolts, pins, grooves, welds, rivets, threaded fasteners, and/or other suitable fittings) to center the housing 128 within the winch drum 102. When the housing 128 is disposed within the winch drum 102 and secured to the winch base 106, the housing 128 is stationary with respect to the rotatable winch drum 102, and the space between the inner face of the winch drum 102 and the outer surface of the housing 128 does not vary when the winch 100 is in operation. Furthermore, in many embodiments, the outer diameter of the housing 128 remains equal distance from the inner face of the winch drum 102 along the longitudinal length of the housing 128. In many embodiments, the attachment means 112 securing the housing 128 to the winch base 106 are evenly distributed about the circumference of the housing 128, as shown in FIG. 3.

The motor assembly 130 is disposed within the housing 128 with a space between the inner surface of the housing 128 and the internally disposed motor assembly 130 to allow air to pass by and cool the motor 100 components. The housing 128 incorporates this ventilation to easily exchange the hot air for ambient or cool(er) air. Furthermore, the housing 128 resides in the winch drum 102 evenly disposed from the inner face of the winch drum 102 as to least hinder airflow through the winch drum 102.

In accordance with a feature of this invention, this compact motor assembly housing 128 may be greatly reduced in size and weight from the standard motor housings or cases. In general, the diameter and length of the housing 128 is dependent upon the size of the motor assembly 130, the diameter of the winch drum 102, and/or the desired gap distance between the outer diameter of the housing 128 and the inner face of the winch drum 102. In some embodiments, the gap is less than ¼ inch, less than ½ inch, ½ to 1 inch, 1 inch to 2 inches, 2 inches to 3 inches, 3 to 5 inches, or greater than 5 inches. In other embodiments, there is no gap between the outer face of the housing 128 and the inner face of the winch drum 102. Additionally, the housing 128 facilitates the connection of the motor assembly 130 with the controller and the power source.

The housing 128 is generally cylindrical in shape with an outer diameter less than the inner diameter of the winch drum 102 to center the housing 128 within the winch drum 102. Other shapes, such as a box, may be used as well so long as the motor assembly 130 is capable of being secured and mounted within the winch drum 102. In some embodiments, the housing 128 is a platform (e.g., plank, slab, support, board) which supports the motor assembly 130 within the winch drum 102. Further embodiments provide a platform which slides in and out of the winch drum 102.

The housing 128 is often comprised of a sheet metal but may be any suitable material capable of resisting deformation in cases of excess heat produced from the motor assembly 130. Such materials that have been identified may include, but are not limited to, aluminum, thermoplastics, steel, and stainless steel. Other materials include the disclosed materials below or any material thereof capable of supporting the weight and operation of the motor assembly 130.

In many instances, the housing 128 is open on at least one axial end of the winch drum 102, preferably both axial ends, to provide adequate passive air flow through and around the motor assembly 130 to dissipate heat and allow easy access to the motor assembly 130. The housing 128 centers the motor assembly 130 within the winch drum 102 to allow more surface area of the motor assembly 130 to be cooled. Air flow may be permitted through both ends of the housing 128 or may be restricted to flowing in and out by one end only. For increased air cooling, an air blower or impeller may be installed to provide active air circulation. In some embodiments, air flow is directed through specific channels (e.g., ducts). In other embodiments, the housing 128 is partially closed on one or more ends or is completely enclosed (e.g., waterproof, liquid-tight).

Drive Means

The drive means 136 directly engages the gearbox 134 of the motor assembly 130 and connects to the winch drum 102 to translate the torque and power generated by the motor 132 into rotation of the winch drum 102.

The drive means 136 comprises a drive shaft 139 and a drum engagement means 138. In general, the drive shaft 139 is a mechanical part such as a rod, shaft, bar, element, or connection device capable of connecting the motor assembly 130 (most often the gearbox 134) with the drum engagement means 138. When engaged with the drum engagement means 138, the rotation of the drive shaft 134 transmits to rotation of the winch drum 102. The drum engagement means 138 comprises a suitable connection between the drive shaft 139 and the winch 100 to accommodate rotation of the winch drum 102 by way of the turning of the drive shaft 139 which most often is made by a connection to the winch drum 102 but may be any appropriate portion of the winch 100 including bearing means 104 or external portion of the winch drum 102. In some embodiments, the drum engagement means 138 is engaged with the inner face of the winch drum 102. The drum engagement means 138 may be any suitable connector to cause rotation. Exemplary connectors include a disk like a drive plate, flex plate, flywheel, or web, a mount, a bar, a gear, or the like. In one embodiment, the drum engagement means 138 is a metal drive plate which is attached to the inner face of the winch drum 102.

The drive shaft 139 projects from its engagement with the motor assembly 130 gearbox 134 residing in the housing 128 through the hollow center region of the winch drum 102 to connect to the drum engagement means 138. The drive shaft 139 transmits the movement of the gearbox 134 components (i.e., the gears therein) into rotation of the winch drum 102 wherein the drive shaft 139 is rotated about a longitudinal axis by the turning of the gearbox 134 which thereby turns the drum engagement means 138. During the operation of the winch 100, the drive shaft 139 rotates and turns the drum engagement means 138, rotating the winch drum 102 in the forward or the reverse direction. When the winch 100 is stationary, the drive shaft 139 does not rotate.

The drive shaft 139 may connect to the gearbox by any suitable manner now known to or later discovered by those in the art. Examples of suitable connections include, but are not limited to a universal joint, a jaw coupling, a splined joint, a key joint, a Hirth joint, a prismatic joint, or other attachment to align and complete the distance between the motor assembly 130 and the drum engagement means 138 and translate the relative movement of the gearbox 134 to the axial rotation of the drive shaft 139.

Base

The winch base 106 provides the interface for mounting to the platform (be it the deck of the vessel, truck bed, ground, or other external surface) for secure attachment and support of the winch 100 assembly. The winch drum 102 is mounted across the winch base 106, as shown in FIG. 1; the winch base 106 is connected to one side of the bearing means 104, and the bearing means 104 supports the winch drum 102 by attachment to the flanges 140. The winch base 106 supports the attachment of the levelwind mechanism 108, allowing the levelwind mechanism 108 to transverse the length of the winch drum 102. In many embodiments, the winch base 106 is capable of mounting to a turntable 116 for rotating the winch 100 about a vertical axis.

Figure 4:
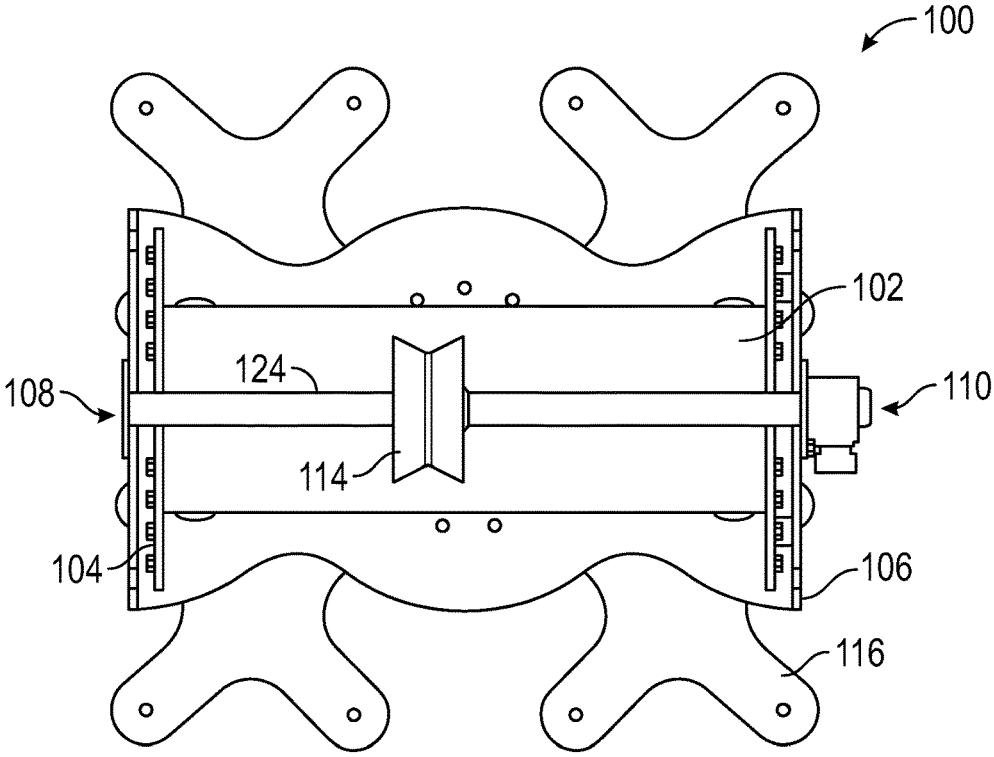
FIG. 4 is a top view according to one embodiment of the invention.

The winch base 106 most often comprises a flat mounting surface, however this portion of the winch base 106 may be any appropriate design or shape (e.g., rectangular, square, free form, round) capable of supporting the winch drum 102 and other components securely to the platform. In some embodiments, the mounting surface comprises cutout regions to reduce weight and consumed space (as shown in FIG. 4). The mounting surface may comprise attachment points or holes to attach to a turntable 116 or directly to the underlying platform. In other embodiments, the mounting surface is reduced to a size about the footprint of the winch drum 102.

In several embodiments, the winch 100 comprises a low level winch base 106 wherein the low level winch base 106 allows the winch drum 102 to be mounted substantially close (e.g., low) to the platform to which it is mounted. In some embodiments, the low level winch base 106 supports the winch drum 102 with a substantially close distance 141 between the flange 140 and the mounting surface. Said close distance 141 may be less than 12 inches, less than 10 inches, less than 8 inches, less than 6 inches, less than 4 inches, less than 2 inches, or less than 1 inch. In other embodiments, the low level winch base 106 supports the winch drum 102 at a space 142 between the bottom of the winch drum 102 and the mounting surface wherein the space 142 is less than 36 inches, less than 30 inches, less than 24 inches, less than 18 inches, less than 12 inches, less than 10 inches, less than 8 inches, less than 6 inches, or less than 4 inches.

Furthermore, the distance between the mounting surface of the winch base 106 and the platform when the winch 100 is mounted on a turntable 116 may be less than 24 inches, less than 18 inches, less than 12 inches, less than 10 inches, less than 8 inches, less than 6 inches, less than 4 inches, less than 2 inches, or less than 1 inch. Obviously, embodiments may be made at greater distances.

From the mounting surface, two side portions project vertically to support the winch drum 102. Each side portion may comprise a plurality of attachment points for securing other winch 100 components such as the bearing means 104 and/or the levelwind mechanism 108 with the attachment means 112. The side portions are generally symmetrical, but may individually vary in size and shape.

Depending on the maximum weight rating for the winch 100, the winch base 106 is formed from a high strength material of an appropriate thickness; in some embodiments, the winch base 106 is made from steel or a steel alloy material of a thickness of less or equal to ¼ inch, less than ½ inch, less than 1 inch, 1 to 2 inches, 2 to 4 inches, or in some cases, greater than 4 inches up to 10 inches in thickness. Furthermore, some embodiments include a winch base 106 which has certain portions of the winch base 106 at a select thickness and other portions at a different thickness.

Bearing Means

The bearing means 104 is a load-bearing assembly and provides for the rotatable interface between the winch base 106 and the rotatable winch drum 102, allowing the winch drum 102 to move independently of the winch base 106 when the motor assembly 130 provides the means for rotation or when manipulated manually. The bearing means 104 supports the winch drum 102, and reduces the load bearing on the flanges 140.

The bearing means 104 is generally a bearing comprising a rotatable surface and a fixed surface. The rotatable surface most often attaches to the winch drum 102, and the fixed surface attaches to the winch base 106; in some embodiments, the rotatable surface attaches to the winch base 106, and the fixed surface attaches to the winch drum 102. In many embodiments, the bearing means 104 is attached to an axial end of the winch drum 102 by the flange 140. In other embodiments, the bearing means 104 is attached to an axial end of the winch drum 102 at another suitable position such as any point along the circumference of the winch drum 102 end.

Suitable bearings generally have a diameter capable of interfacing with the winch base 106 and the winch drum 102, a narrow profile for maintaining a compact winch footprint, and the ability to manage heavy loads or force reliably. Preferred bearings for some embodiments may additionally comprise an open internal diameter suitable for sliding the housing 128 comprising the motor assembly 130 through the center of the bearing into the winch drum 102. Any appropriate rotational means as used by one in the art includes roller bearings, angular contact bearings, ball bearings, spherical bearings, plain bearings, magnetic bearings, thin section bearings, thrust bearings, needle bearings, or the like. In some embodiments, the bearing means 104 uses one or more rolling element bearings such as ball bearings, and in particular slewing bearings. In further embodiments, the bearing means 104 is comprised of single row ball bearings which provide high rotational precision. Other embodiments use other types of ball bearings including two row ball bearings, cross roller bearings, or three row ball bearings as found to be appropriate considering the hauling criteria.

In many embodiments, the winch 100 comprises a bearing means 104 disposed on each axial end of the winch drum 102. In some embodiments, the winch 100 comprises one bearing means 104 disposed on one axial end of the winch drum 102.

The bearing means 104 is attached to the winch base 106 and to the winch drum 102 using bolts to allow secure attachment that can be removed for inspection or maintenance. In some embodiments, the bearing means 104 is secured by the means of welds, rivets, pins, nuts, threaded fasteners, or other means less removable than bolts.

Levelwind Mechanism

In some embodiments of the winch 100 may also comprise a levelwind mechanism 108 to assist the spooling (e.g., winding) of the cable evenly by providing tension to the cable and moving along the revolving axis of the winch drum 102 to carefully lay down the cable during retrieval or to unwind cable during deployment. In the absence of a levelwind, the cable is more prone to bunch or cluster in uneven mounds along the length of the winch drum 102, creating tangles in the cable and hindering the hauling activities. In general, the winch 100 may utilize any levelwind (e.g., line guide, cable guide, guide, spooler) or other suitable mechanism for laying down or winding cable along any shaped path of the axial length of the winch drum 102. In some embodiments, the winch 100 comprises the improved levelwind mechanism 108, shown in FIG. 2.

One major aspect of the levelwind mechanism 108 is the lightweight design due to the reduction in material. In conventional levelwind constructions, a high strength beam assembly, employed at a frontal level position with the winch drum 102, is necessary in order to maintain cable organization under the torsional forces applied by the cable under load. The improved levelwind mechanism 108 is reduced from two high strength bars down to a single lightweight beam 112, as shown in FIG. 1. The levelwind mechanism 108 may be arranged to any appropriate position on the winch 100 to provide reliable cable spooling. In certain embodiments, the levelwind mechanism 108 is positioned above the winch drum 102 and directs the wind of the cable from above the winch drum 102. In other embodiments, the levelwind mechanism 108 is placed in a non-load bearing position on the winch 100. In another embodiment, the winch 100 does not comprise a levelwind mechanism 108 and may use an alternative method for distributing cable.

The levelwind mechanism 108 comprises a sheave 114, a carriage 118, a screw nut 120, a lead screw 122, a beam 124, a levelwind motor assembly 110, and a levelwind frame 126. As illustrated in FIG. 1, the beam 124 extends the length of the winch drum 102 and is supported by the levelwind frame 126. The levelwind frame 126 may be any structure capable of lending support for the rotating action of the sheave 114 and its levelwind motor assembly 110. The sheave 114 is usually an open groove guide for the cable to sit in, supported on the carriage 118 with the carriage 118 disposed on the beam 124. The carriage 118, attached to the lead screw 122 by a screw nut 120 or other attachment means, is shiftably guided along the length of the beam 124 and driven by the lead screw 122.

The sliding motion of the carriage 118 and attached assembly is provided by the levelwind motor assembly 110 rotating the guide beam 124. The levelwind motor assembly 110 is often powered by an electric motor but may be any motor or any motive force including a DC electric motor, AC motor, hydraulic motor, manual crank, gear drive, chain drive, belt drive, hydraulic drive, winch drive, electric drive, etc. known in the art. Rotation of the guide beam 124 revolves the lead screw 122, resulting in the axial movement of the carriage 118 and sheave 114 assembly along the length of the winch drum 102.

The levelwind mechanism 108 is typically comprised of metal or mechanical grade plastic, but may also be constructed from other suitable materials or composites. Furthermore, the levelwind components may be formed of any shape and size such as the sheave 114 to accommodate various cable types. In some embodiments, one or more of the components of the levelwind mechanism 108 is coated in a protective coating (such as one described below) for increased resistance to the environment.

The levelwind mechanism 108 may be operated by the controller or by a separate means of operation. Additional sensors may be added to the levelwind mechanism 108 to assist guidance of the sheave 114 and/or cable such as a sheave sensor (e.g., motion sensor) for monitoring upward and downward motion in a marine setting, load sensors for cable tension control, or the like.

Controller

The controller controls the various operations of the winch 100 by regulation of the motor assembly 130 which in one or more embodiments may include on or more of the following: activation of rotation, stopping of rotation, forward or reverse rotation direction, speed of rotation, and other functions. In some embodiments, the controller is engaged with the winch 100 power supply and provides a signal(s) to the motor assembly 130 to activate the motor 132 and provides the motor assembly 130 with power to rotate the winch drum 102 in the desired direction to raise or lower the cabled load. In other embodiments, the controller is engaged with the winch motor assembly 130 by any suitable means.

The controller comprises an operator station and a motor control means, and in some embodiments, an additional remote control device to operate the winch 100 from a separate position on the platform. The controller may comprise a Programmable Logic Controller (PLC), a touch screen, a monitor, a plurality of buttons, an emergency stop, etc., although any controller found suitable by one skilled in the art for the operation of the winch 100 may be employed. In some embodiments, the controller is waterproof.

Generally, the operator station transmits signals to the motor control means via a connection to the motor assembly 130 that may be wired or wireless. The operator station is capable of transmitting commands such as start and stop of rotation in either the forward direction and the reverse direction and the speed at which the winch drum 102 turns. The controller may comprise additional features including an emergency stop function or monitoring of parameters such as cable position, cable overspill, cable slack, levelwind control, etc.

The controller may be affixed to the winch 100 ("at winch" controller) or may be plugged into the winch 100 ("local" controller) to allow the operator to stand at a nearby location. In some embodiments, the winch 100 is operated by a handheld controller ("remote" controller) either through a wired or wireless (e.g., Bluetooth, optical, acoustic, or other suitable means) connection. In some embodiments, the controller is a portable unit which can be plugged/unplugged into the winch 100.

In some embodiments, additional components are used with the controller such as sensors for cable tension, cable length deployed, cable speed, cable angle, cable slippage, motion (e.g., vertical heave, sideways motion, heave sensor), and other similar or like sensors.

Quick Removal Means

The winch 100 components are laid out in a special arrangement that provides for the means to easily access, remove, and exchange the motor assembly 130 and/or drive means 136 disposed within the winch drum 102. As applied in the instant invention, such an arrangement is termed the "quick removal means." The quick removal means allows one or more components disposed within the winch drum 102 to be disengaged by any suitable manner without dismantling the entirety (e.g., removing the winch drum 102 from the winch base 106, removing the levelwind 108, detaching the winch 100 from the platform or turntable 116, disconnecting the bearing means 104, etc.) of the winch 100. The motor assembly 130 held center by the housing 128 is disengaged and removed by sliding the housing 128 through one axial end of the winch drum 102. In some embodiments, the quick removal means involves detaching the drum engagement means 138 from the winch drum 102, allowing the entire assembly comprising the drive means 136, the motor assembly 130, and the housing 128 to exit the winch drum 102. In other embodiments, the drive shaft 139 disengages the drum engagement means 138 to permit the drive shaft 139, the motor assembly 130, and the housing 128 to be removed from the drum 102. In other embodiments, the drive shaft 139 disengages from the gearbox 134, allowing the gearbox 134, the motor 132, and the housing 128 to exit the winch drum 102. In other embodiments, the motor 132 is disengaged from the gearbox 134, and only the motor 132 and the housing 128 are removed.

Winch Materials

In instances where the winch 100 is made for operation in the marine or an otherwise wet environment, the winch 100 is most often fabricated from materials capable to resist corrosion and oxidation while providing the strength and fatigue properties to resist wear and tear as subjected to under the demands of heavy cabled loads.

The winch 100, including components such as the winch drum 102, the winch base 106, the levelwind mechanism 108, the housing 128, and other components which bear weight are comprised of one or more high strength structural materials capable of resisting deformation under applied force. Although several types of material may be suitable for construction, the winch 100 components are generally fabricated from metal, preferably steel, stainless steel, steel alloys, titanium, cast iron, copper, mechanical grade plastics like thermoplastics, fiberglass, composite materials, or any combination thereof. In many embodiments, the winch drum 102, the winch base 106, and the housing 128 are manufactured from metal, and more preferably steel, of a suitable thickness and strength for withstanding the forces applied thereto. In some embodiments, some or all of winch 100 components are built using aluminum or aluminum alloy to greatly reduce the weight of the winch 100 and provide a more portable version suitable for lighter hauling tasks.

Various components of the winch, including the winch drum 102, the winch base 106, the attachment means 112, the housing 128, or other suitable parts, may be laminated in a protective coating to increase resistance to corrosion or decay from the surrounding environment. In some embodiments, components of the winch 100 are furnished with a suitable coating such as zinc (e.g., inorganic zinc), chrome plating, paint, epoxies (e.g., ceramic epoxy), polymers (e.g., fluoropolymer, polytetrafluoroethylene (PTFE), polyphenylene sulfide (PPS), ethylene propylene, polyurethane, polyvinylidene fluoride (PVDF), ethylene chlorotrifluoroethylene (ECTFE)), paint (e.g., molybdenum disulfide, phenolic, phosphate) or other coatings known in the art. In other embodiments, metal components of the winch 100 are composed of materials which have been galvanized (e.g., hot-dipped galvanized, electrogalvanized) or chrome plated.

In general, the winch components are assembled and attached using attachment means 112 (as illustrated in FIG. 3) such as fasteners including but not limited to nuts and bolts, pins, grooves, welds, rivets, threaded fasteners, or other suitable fittings. In some embodiments, such attachments means 112 are also coated with a corrosion-resistant coating or galvanized. The size or length of the attachment means 112 varies depending on the thickness of the material and washers, if needed, for assembly. In yet other alternate embodiments, certain components may be welded together when they do not require independent motion from each other.

Cable

The winch 100 may be adapted to use a plurality of cables or ropes of various materials and breaking strengths depending on the hauling load. Suitable cables or lines include rope, strap, cord, tube, wire, chain. Further examples include but are not limited to wire (e.g., metal, steel, stainless steel, copper, titanium), synthetic rope (e.g., polyester, polyethylene, thermoplastics, polytetrafluoroethylene, and/or nylon ropes), aramid fiber, liquid crystal polymer fiber, Polyethylene terephthalate (PET) fiber, single strand line, multistrand (e.g., weave) line, fiber optic (e.g., light guide), 0.322" CTD cable, or any other appropriate cable for use with winches or for hauling purposes. In one embodiment, the winch 100 employs a 3×19 (3 strands, 19 wires per strand) wire rope.

In some cases, the cable is coated or jacketed for additional break resistance against abrasion, salt, water, marine biofouling, or chemical corrosion such as from oxidation. Such protective coatings or treatments include galvanized coating with zinc, a jacket (e.g., braided jacket, plastic jacket, extruded plastic jacket, combination material jacket), lubrication, polyurethane, resin, heat treatment, or any appropriate method to minimize wear and tensile fatigue.

Any length of cable may be used on the winch 100 which is dependent on the diameter and length of the winch drum 102 up to 50,000 feet or more. In certain embodiments, the winch 100 comprises 100 feet, up to 500 feet, up to 1,000 feet, 1,000 to 5,000 feet, 5,000 to 10,000 feet, 20,000 feet, 30,000 feet, or more of cable wrapped on the winch drum 102. In some embodiments, the cable is rated for ocean bottom exploration and made of wire rated for about 100,000 psi, 200,000 psi, or 300,000 psi or more.

Cable sizes include less than ⅛ inch, ¼ inch, 7/32 inch, 5/16 inch, ⅜ inch, 5/16 inch, 7/16 inch, ½ inch, ⅝ inch, ¾ inch, ⅞ inch, 1 inch, 1⅛ inches, 1¼ inches, 1⅜ inches diameter, 2 inch or more, or any suitable cable capable of winding about the winch drum 102. Cables may be rated for working loads less than 100 lbs, up to 1,000 lbs, up to 2,000 lbs, up to 5,000 lbs, up to 10,000 lbs, and up to 50,000 lbs, to or greater than 100,000 lbs or more.

Optional Turntable

The winch 100 may be directly mounted to a platform for a fixed position or may be attached to an additional mounting plate or structure such as a turntable 116. An exemplary turntable 116 is found in the U.S. Provisional Patent Application No. 62/090,672 "Portable Turntable and Winch" which allows the winch 100 to be easily manually rotated in any direction or locked to a fixed position. As shown in FIGS. 2 and 3, the light weight, compact winch 100 is easily mounted on the turntable 116 using suitable attachment means 112 to provide precise angular position for hauling purposes; the winch 100 and turntable 116 can also be easily removed for repositioning to another area on the platform. The winch 100 may be designed for compatibility with a plurality of other mounting plates, structures, or turntables 116 known to those skilled in the art.

Methods of Use

The winch 100 is generally operated as follows. The winch 100 is secured to a platform (e.g., deck), directly or to a turntable 116 mounting base by attachment means 112 and mounted to the platform relative to where the winch operation will occur. Upon suitable rigging of the cable and the load for deployment or retrieval, the winch 100 is attached to a power source and in communication with the controller by the operator.

As the operator employs the controller, signals are provided to the motor assembly 130 (or other suitable component) to actuate the winching mechanism for hauling, deploying, supporting etc. (depending on the application), causing the winch drum 102 to rotate in a forward or reverse direction as determined by the operator. Power is provided to the motor assembly 130 which is translated into rotational motion via the drive means 136 coupling the drum engagement means 138 to turn the winch drum 102. The turning of the winch drum 102 winds the cable on or off of the winch drum 102 in a speed-controlled manner which is determined by the controller or by a pre-set speed. After a series of rotations, the attached load is deployed, retrieved, or supported from the platform. The repetitive turning of the winch drum 102 for retrieval winds the cable back onto the winch drum 102 in an evenly distributed manner via the levelwind mechanism 108 (or other method), returning the cable back to its storage position.

The levelwind mechanism 108 guides the cable onto the winch drum 102 through the sheave 114 to evenly spool the cable about the revolving axis and equally across the axial length of the winch drum 102. The levelwind mechanism 108 may also lead the cable from the winch drum 102 over to additional sheaves 114 or other rigging components set up on the platform for the deployment of the attached load.

When the winch 100 in not in operation, the motor brake or similar means prevents the unnecessary rotation of the winch drum 102.

In instances where the winch 100 is desired at another position on the platform, the winch 100 may be uninstalled by removing the attachment means 112 from the winch base 106 or from the turntable 116. The lightweight winch 100 may then be moved and re-bolted to another selected position on the platform. In some embodiments, the winch 100 is repositioned by rotation on the turntable 116.

The terms and expressions employed herein are used as terms and expressions of description and not of limitation, and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. The compositions, components, and functions can be combined in various combinations and permutations, to achieve a desired result. For example, all materials for components (including materials not necessarily previously described) that are suitable for the application are considered within the scope of the invention. Accordingly, the described embodiments are to be considered in all respects as only illustrative and not restrictive. Furthermore, the configurations described herein are intended as illustrative and in no way limiting. Similarly, although physical explanations have been provided for explanatory purposes, there is no intent to be bound by any particular theory or mechanism, or to limit the claims in accordance therewith.

For the purpose of understanding the Compact Winch apparatus, references are made in the text to exemplary embodiments of a Compact Winch, only some of which are described herein. It should be understood that no limitations on the scope of the invention are intended by describing these exemplary embodiments. One of ordinary skill in the art will readily appreciate that alternate but functionally equivalent components, materials, designs, and equipment may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

Reference throughout this specification to features, advantages, or similar language does not imply that all of the features and advantages that may be realized should be or are in any single embodiment. Rather, language referring to the features and advantages is understood to mean that a specific feature, advantage, or characteristic described in connection with an embodiment is included in at least one embodiment. Thus, discussion of the features and advantages, and similar language, throughout this specification may, but do not necessarily, refer to the same embodiment.

Furthermore, the described features, advantages, and characteristics may be combined in any suitable manner in one or more embodiments. One skilled in the relevant art will recognize that the act of hoisting, lifting, lowering, and supporting with a winch may be practiced without one or more of the specific features or advantages of a particular embodiment. In other instances, additional features and advantages may be recognized in certain embodiments that may not be present in all embodiments.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment.

Moreover, the terms "substantially" or "approximately" as used herein may be applied to modify any quantitative representation that could permissibly vary without resulting in a change to the basic function to which it is related.

What is claimed is:

1. A winch apparatus, comprising:

a horizontal winch drum for storing cable comprising two axial ends and a flange on at least one axial end;

a disengagable motor assembly comprising a motor, a gearbox, and a housing;

a drive means comprising a drive shaft and a drum engagement means;

a bearings means;

a base; and a motor assembly quick removal means to allow for the removal of the motor assembly without dismantling the entirety of the winch;

wherein the drum engagement means is engaged with (i) an inner face of the winch drum and (ii) the housing; and the motor assembly quick removal means detaches the drum engagement means from the winch drum, allowing the drive means, the motor assembly and the housing to exit the winch drum;

wherein at least the motor is centered within the housing, the housing is at least partially disposed within the winch drum with a gap between the outer face of the housing and the inner face of the winch drum, and the housing is connected to the base;

the motor assembly is engaged with the winch drum by means of the drive means through at least one axial end of the winch drum;

the bearing means supports the winch drum, and the bearing means is attached to an axial end of the winch drum and is attached to the base;

the motor assembly may be disengaged from the winch drum using the quick removal means without dismantling the entirety of the winch;

the winch is capable of hauling and supporting a heavy load on a cable; and the motor is capable of controllably rotating the winch drum.

2. The winch of claim 1, wherein the bearing means is a load-bearing assembly that comprises a ball bearing selected from a roller bearing, a slewing bearing, a thin section bearing, a thrust bearing, and a needle bearing.

3. The winch of claim 1, wherein the bearing means comprises a rotatable surface attached to the winch drum and a fixed surface attached to the base.

4. The winch of claim 1, wherein the motor assembly comprises a motor selected from the group comprising an electric motor, a hydraulic motor, a synchronous motor, an induction motor, an AC motor, a DC motor, a slip ring motor, and a permanent magnet motor.

5. The winch of claim 1, further comprising a levelwind mechanism to at least partially direct the cable as it winds about the winch drum.

6. The winch of claim 5, wherein the levelwind mechanism is arranged above the winch drum.

7. The winch of claim 1, wherein the gearbox is a helical gear assembly engaged with the motor and the drive means.

8. The winch of claim 1, wherein the winch drum is adapted to wind a cable selected from wire, rope, synthetic rope, strap, cord, tube, chain, aramid fiber, liquid crystal polymer fiber, fiber optic cable, single strand line, multi-strand line, Polyethylene terephthalate (PET) fiber, and (CTD) cable.

9. The winch of claim 1, further comprising a controller in communication with the motor assembly to regulate winch operation.

10. The winch of claim 9, wherein the controller is a wired or wireless portable unit that can be plugged into the winch.

11. The winch of claim 1, wherein the winch drum is unsealed on at least one axial end of the drum.

12. The winch of claim 11, wherein the winch drum comprises an open internal diameter suitable for sliding the motor assembly through the winch drum on the at least one axial end of the drum.

13. The winch of claim 12, wherein the motor assembly disposed within the housing is cooled by ambient air entering the at least one unsealed axial end of the drum.

* * * * *